US005244195A

United States Patent [19]

Lawrence et al.

[11] Patent Number: 5,244,195

[45] Date of Patent: Sep. 14, 1993

[54] CLAMPING FIXTURE

[75] Inventors: Clyde A. Lawrence, Flemington, N.J.; Ivan Pawlenko, Holland; Brian D. Potteiger, Reading, both of Pa.

[73] Assignee: AT&T Bell Laboratories, Murray Hill, N.J.

[21] Appl. No.: 976,762

[22] Filed: Nov. 16, 1992

[51] Int. Cl.[5] ..... B25B 1/06

[52] U.S. Cl. ..... 269/227; 269/233; 269/239

[58] Field of Search ..... 269/227, 233, 239, 34, 269/229, 235, 258-266

[56] References Cited

U.S. PATENT DOCUMENTS

| | | | |
|---|---|---|---|
| 1,075,506 | 10/1913 | Smith | 269/239 |
| 1,322,612 | 11/1919 | Proske | 269/34 |
| 2,887,918 | 5/1959 | Benson | 269/239 |
| 3,084,893 | 4/1963 | Ruth | 269/233 |
| 3,953,016 | 4/1976 | Gersbacher | 269/258 |
| 4,240,621 | 12/1980 | Daddato | 269/264 |

FOREIGN PATENT DOCUMENTS

| | | | |
|---|---|---|---|
| 1187981 | 12/1984 | U.S.S.R. | 269/34 |

*Primary Examiner*—Robert C. Watson
*Attorney, Agent, or Firm*—Robert B. Levy

[57] ABSTRACT

A clamping fixture (10) for releasably clamping a workpiece (12) to avoid damage to the workpiece comprises a support (40) having a pair of arms (60,62) mounted thereto for rotation to and from each other. Each arm has a jaw assembly (68,70) spring-biased thereto opposite the jaw assembly on the other arm so that each jaw assembly can "float" along each of the x, y and z axes. When the arms are rotated together, the jaw assemblies conformally grip the workpiece therebetween with a reduced incidence of damage.

6 Claims, 5 Drawing Sheets

CLAMPING FIXTURE

TECHNICAL FIELD

This invention relates to a fixture for releasably gripping a workpiece to permit an operation, such as a welding operation, to be performed thereon.

BACKGROUND OF THE INVENTION

When performing a manufacturing operation on a workpiece, such as a welding or drilling operation, for example, the workpiece is invariably held tightly in place to permit the operation to be carried out with the requisite degree of precision. In some instances, the nature of the workpiece and the type of operation to be performed thereon are such that an operator can simply hold the workpiece with his/her hands while the particular operation is carried out. More often than not, the nature of the workpiece, and the degree of precision required to carry out the operation, are usually such that some type of fixturing is required to rigidly hold the workpiece in place.

Most types of fixtures can classified into two types, those which are manually operated and those which operate automatically. Manually operated fixtures require that a human operator secure the workpiece in the fixture prior to the outset of a manufacturing operation. At the completion of the operation, the operator releases the workpiece and secures another workpiece in the fixture. In contrast, an automatically operated fixture generally functions to grip a workpiece at the outset of a manufacturing operation and thereafter releases the workpiece at the completion of the operation without the need for any intervention by an operator. Manually operated fixtures are usually best suited for low-volume manufacturing when the time required to manually secure and thereafter manually release the part is small as compared to the overall manufacturing operation, whereas automatically operated fixtures are preferred for high-volume operations.

While automatically operated fixtures afford a savings of human labor as compared to manually operated fixtures, automatically operated fixtures do incur a disadvantage in that they typically offer a very limited ability to accommodate dimensional variations in the workpiece being clamped. As a consequence, when a workpiece having minor dimensional variations is clamped by an automatically operated fixture, damage to the workpiece can result. In contrast, with many manually operated fixtures, an adjustment can easily be made by an operator to accommodate dimensional variations in the workpiece being clamped.

Thus, there is a need for an automatically operated fixture which can automatically clamp, so as to conformally grip, a workpiece at the outset of a manufacturing operation to avoid damage to the workpiece during clamping.

SUMMARY OF THE INVENTION

Briefly, in accordance with a preferred embodiment of the invention, an automatically operated clamping fixture is provided for conformally gripping and thereafter releasing a workpiece with a reduced incidence of damage. The clamping fixture of the invention comprises a support (i.e., a block) having a flat surface thereon. Each of a pair of arms has a first end rotatably mounted to the flat surface of the support so that the second end of each arm can swing to and from the second end of the other arm. Means, including: (1) a cam follower on each arm; (2) a rotatably mounted cam having a pair of opposing arculate slots, each receiving the cam follower on each arm, and (3) an actuator for rotating the cam, are provided for rotating the arms to and from each other. Each arm has a jaw spring-biased to its second end so as to be opposite the jaw on the other arm. The jaws each "float" along three orthogonal axes (x, y and z), thereby allowing a workpiece to be conformally gripped between the jaws when the arms are rotated together.

DETAILED DESCRIPTION

Figure 1:
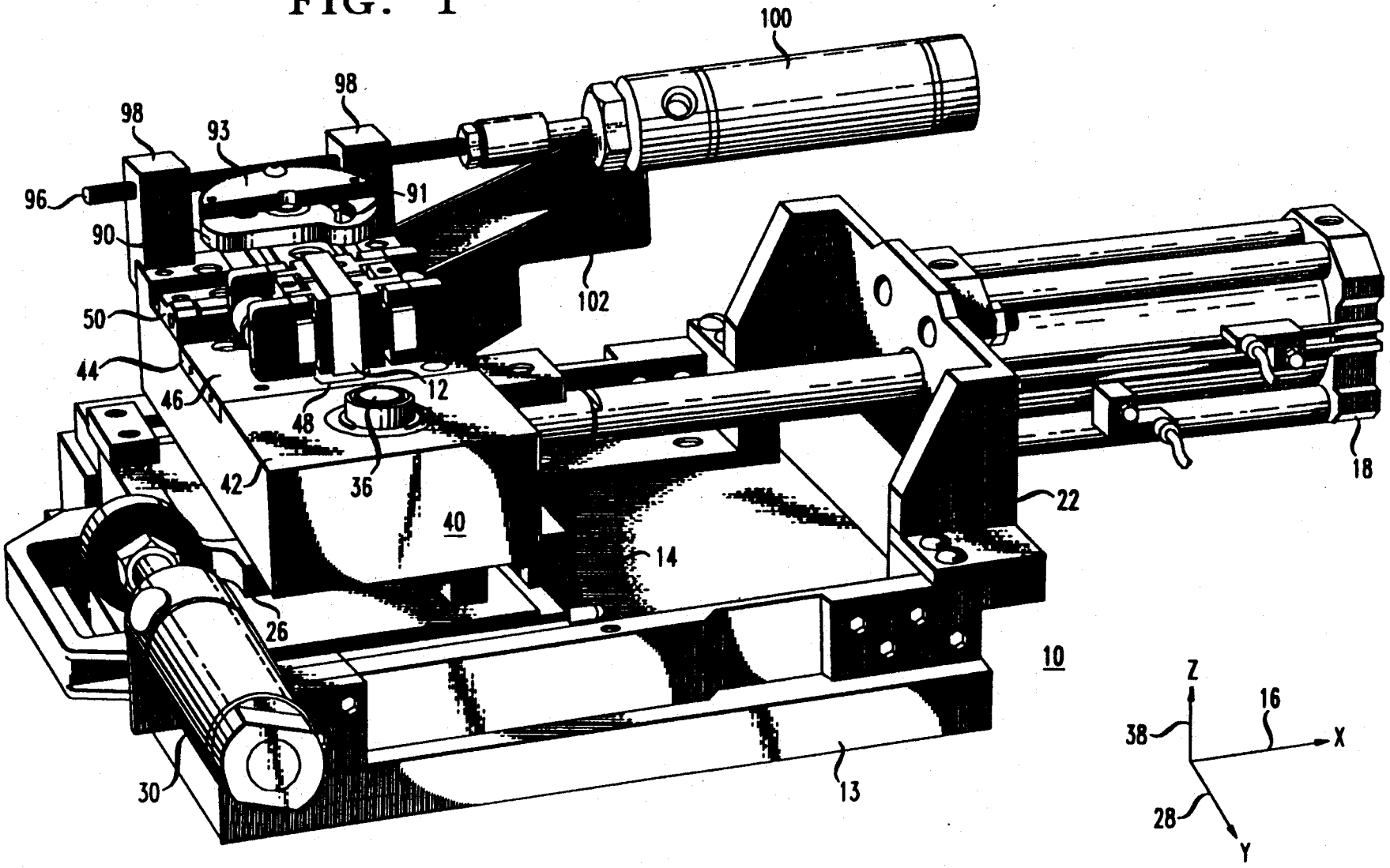
FIG. 1 is a side view, in perspective, of an automatically operated clamping fixture in accordance with a preferred embodiment of the present invention for releasably clamping a workpiece between a pair of clamping arms.

FIG. 1 shows an automatically operated clamping fixture 10, in accordance with the invention, for releasably clamping a workpiece 12, having possible dimensional variations, with a reduced incidence of damage. The fixture 10 of FIG. 1 comprises a frame 13 on which a carriage 14 is mounted for movement in opposite directions along a first (x) axis 16. The carriage 14 is displaced along the axis 16 by a double-acting pneumatic cylinder 18 secured to the frame 13 by a bracket 22.

A slide 26 is slidably mounted to the carriage 14 for movement in opposite directions along a second (y) axis 28 orthogonal to, and lying in the same plane as, the x axis 16. A double-acting pneumatic cylinder 30 is secured between the slide 26 and the carriage 14 for displacing the slide along the y axis 28. A pair of posts 36 (only one shown in FIG. 1) rises vertically from the slide 26 in spaced-apart relationship parallel to a third (z) axis 38 so as to extend through a block 40 which is spring-biased upwardly from the posts.

Figure 2:
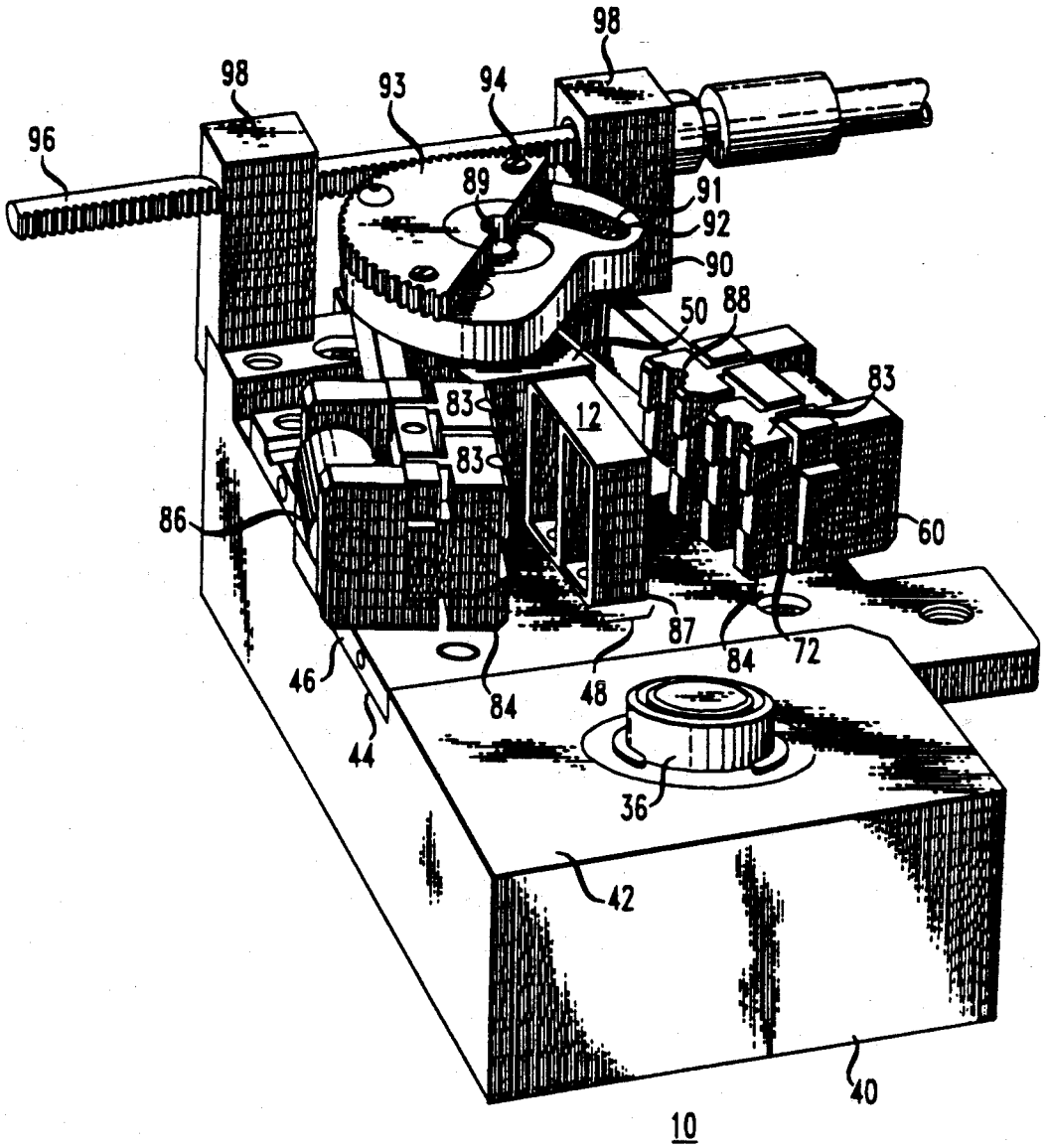
FIG. 2 depicts a portion of the clamping fixture of FIG. 1, showing the clamping arms in an open position.
Figure 3:
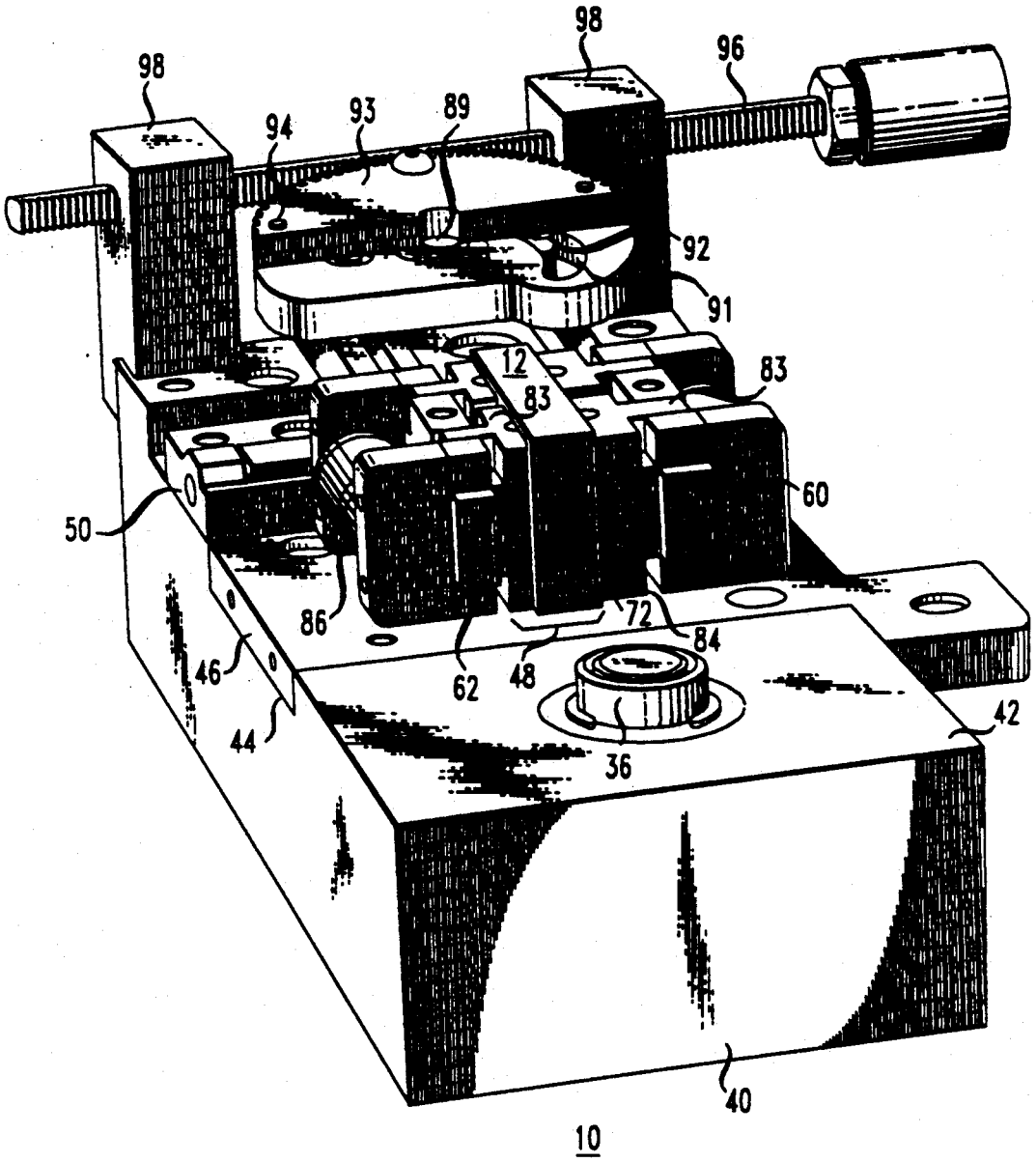
FIG. 3 depicts a portion of the clamping fixture of FIG. 1, showing the clamping arms in a closed position.

Referring to FIGS. 2 and 3, the block 40 has a generally flat upper surface 42. Centrally located on the surface 42 is a region 44 of a reduced height (i.e., a cut-out or step) which is sized to receive a plate 46 having a centrally located area 48 (best seen in FIG. 2) for receiving the workpiece 12. In the exemplary embodiment, a pair of spaced-apart electrodes (not shown) extends vertically through the block 40 and through the plate 46 within the area 48 for enabling a contact resistance welding operation to be performed on the undersurface of the workpiece 12.

Figure 4:
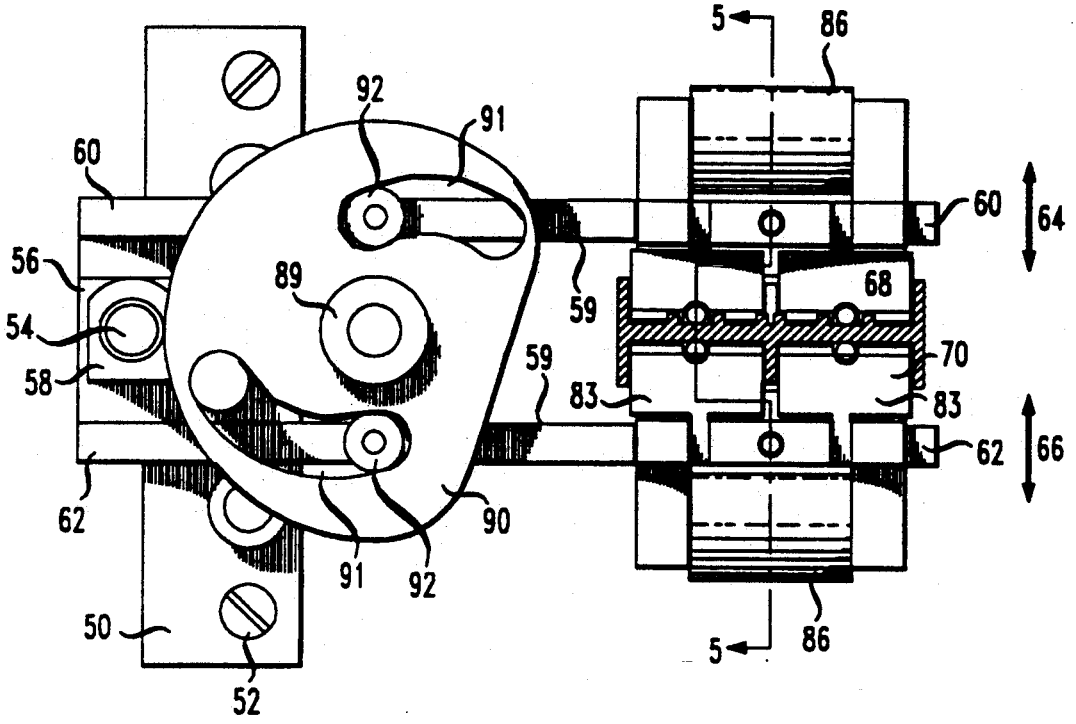
FIG. 4 is a top view of a portion of the clamping fixture of FIG. 1.

As best illustrated in FIG. 2, the upper surface 46 of the block 40 mounts a bracket 50 secured to the surface by a plurality of fasteners 52 (see FIG. 4). Referring to FIG. 4, a first pin 54 rises upward from the bracket 50 and is journalled through a pair of ears 56 and 58, each extending horizontally outward from a first face 59 of a separate one of a pair of arms 60 and 62 so that the ears lie in spaced vertical parallelism with each other. By virtue of the pin 54 being journalled through the ears 56 and 58, the arms 60 and 62 can rotate to and from each other through a separate one of a pair of arcs 64 and 66, respectively.

Figure 5:
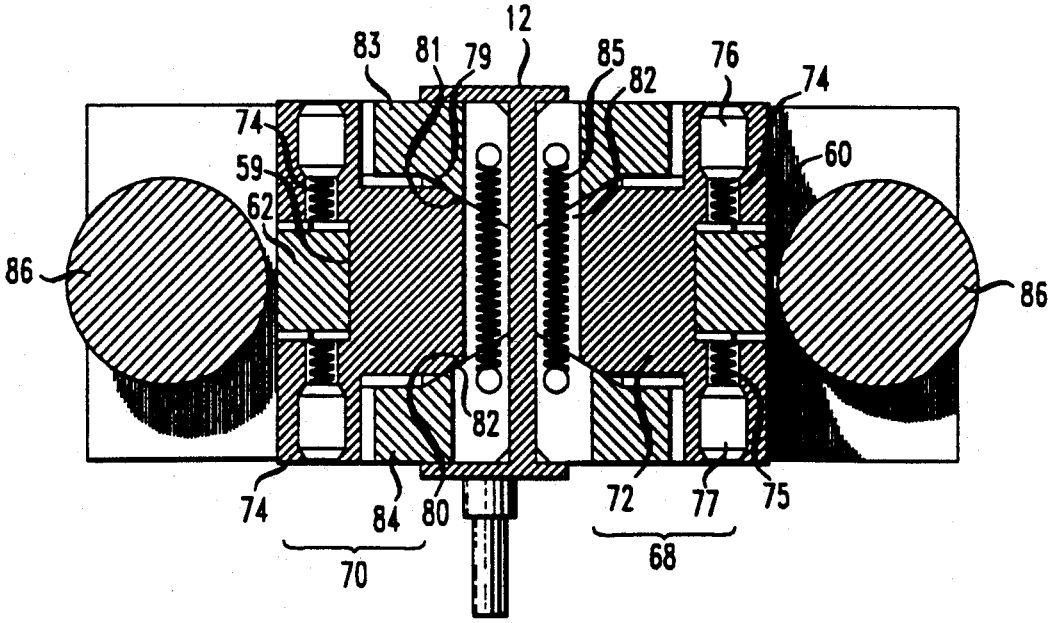
FIG. 5 is a cross-sectional view taken along the plane 5—5 of FIG. 4.

The first face 59 of each of the arms 60 and 62 carries a separate one of a pair of jaw assemblies 68 and 70, respectively, each opposing the jaw assembly on the other arm. Referring to FIG. 5, each of the jaw assemblies 68 and 70 includes an elongated jaw carrier 72 spring-biased to its corresponding arm 60, 62 by a pair of springs 74 and 75, each held in place by a separate one of a pair of screws 76 and 77, to permit the jaw carrier to "float" along the z axis 38. Each jaw carrier 72 has upper and lower chamfered edges 79 and 80, respectively, each seating against one of a pair of correspondingly tapered surfaces 81 and 82, respectively, on a separate one of a pair of upper and lower jaws 83—83 and 84—84, respectively. Each of the upper jaws 83—83 is yieldably urged towards a separate one of the pair of lower jaws 84—84 by a spring 85 coupled therebetween. As the upper and lower jaws 83—83 and 84—84 contact an opposite one of the sides of the workpiece 12, each jaw of the upper pair is urged away from the corresponding one of the lower jaws and against the spring 85 by the wedging action of the jaw carrier 72. In this way, each of the upper and lower jaws 83—83 and 84—84 enjoys a limited degree of movement both rotationally, as well as in the x and y directions. To prevent each of the arms 60 and 62 of FIG. 4 from undue twisting as each of the jaw assemblies 68 and 70 engage the workpiece 12, each arm carries a counterweight 86 attached to the arm face opposite the jaw assembly.

As best seen in FIG. 2, the upper jaws 83—83 and lower jaws 84—84 are each typically configured so as to conformally grip the workpiece 12. In the preferred embodiment, where the workpiece 12 takes the form of an open frame having a plurality of spaced apart ribs 87, each of the pair of upper and lower jaws 78 and 80 has a slot 88 in its forward face for seating a separate one of the ribs 81 of the workpiece.

Referring to FIG. 4, the bracket 50 has a second pin 89 extending vertically upward so as to be journalled through a cam 90 having a pair of arcuate slots 91 extending therethrough in opposed relationship. Each slot 91 in the cam 90 receives a cam follower 92 extending upward from a separate one of the arms 60 and 62. The shape and position of the slots 91 in the cam 90 are chosen such that as the cam is rotated clockwise and counterclockwise, the arms 60 and 62 are rotated to and from each other, respectively, as the cam follower 90 on each arm rides along a separate one of the slots.

As best seen in FIGS. 2 and 3, a semicircular spur gear member 93 is secured to the upper face of the cam 86 by a plurality of fasteners 94, typically screws or bolts. The spur gear member 93 meshes with a gear rack 96 horizontally journalled through each of a pair of supports 98 secured to the rear end of the block 40 (the upper end of the block as shown in FIGS. 2 and 3) so as to lie in spaced, vertical parallelism. Referring to FIG. 1, the gear rack 96 is coaxially attached to the shaft of a double-acting pneumatic cylinder 100 secured to the block 40 via a bracket 102. By appropriately pressurizing the cylinder 100, the gear rack 96 is reciprocated in each of a pair of opposite directions parallel to the x-axis 16. Displacing the gear rack 96 in a first direction (i.e., to the right, as seen in FIG. 1) causes the spur gear member 93, and hence the cam 90, to rotate clockwise, causing the arms 60 and 62 to rotate towards each other so that the jaw assemblies 68 and 70 of FIG. 4 will clamp the workpiece 12 therebetween. When the gear rack 96 is displaced in the opposite direction, the spur gear member 93 and the cam 90 rotate in the opposite direction, causing the arms 60 and 62 to rotate away from each other, releasing the workpiece 12.

Figure 6:
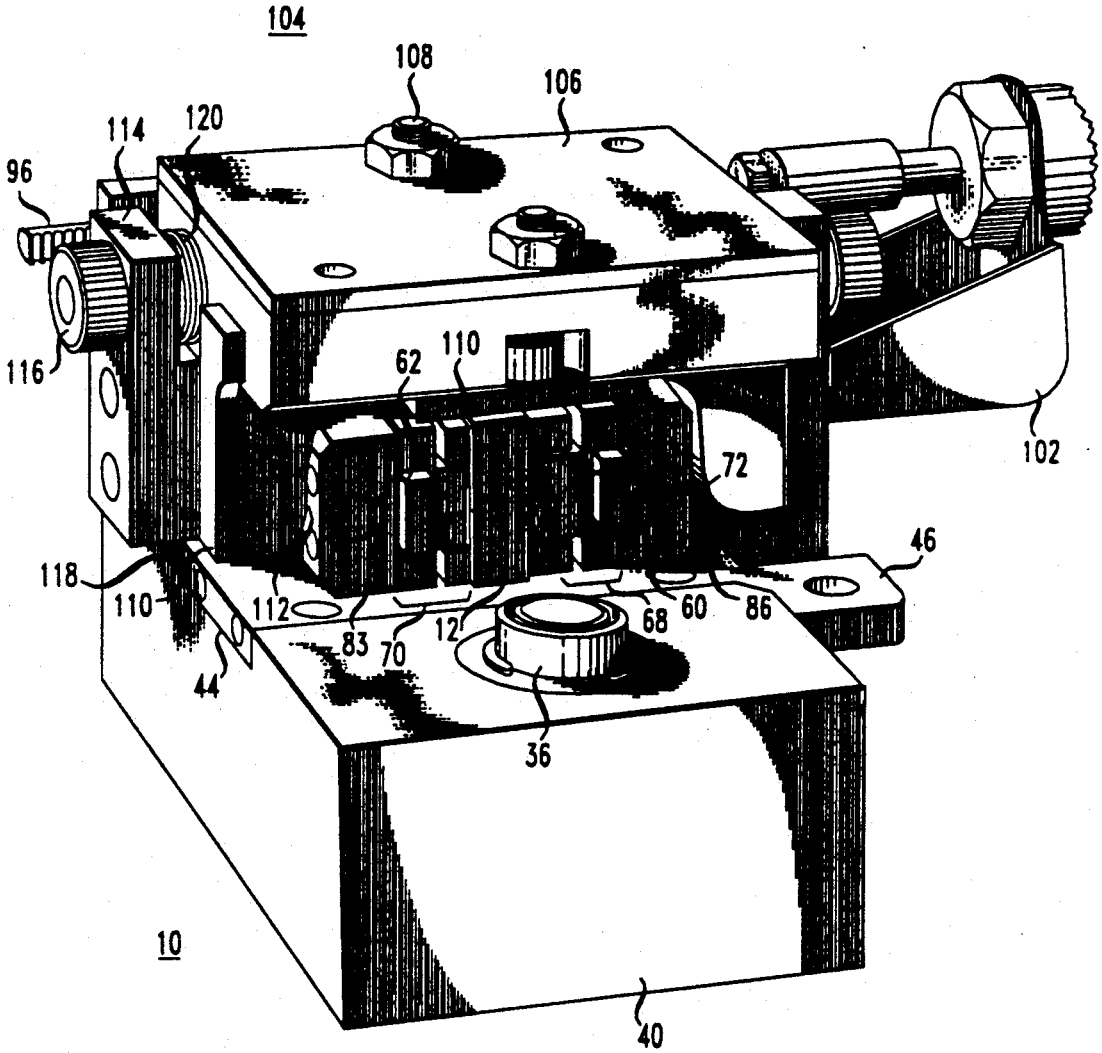
FIG. 6 is a side view, in perspective, of the fixture of FIG. 1, showing a pressure plate placed over the fixture to facilitate the application of a downward pressure on the workpiece.

Depending on the nature of the operation to be performed on the workpiece 12, it may be desirable to apply both a downward pressure as well as an increased side pressure to the workpiece 12. Referring now to FIG. 6, such increased pressure can be applied from a ram (not shown) against a pressure plate assembly 104 sized to overlie the jaw assemblies 68 and 70, when the workpiece 12 is clampled therebetween. The pressure plate assembly 104 includes a slab 106 having a pair of posts 108 which extend vertically therethrough so as to depend therebelow to bear against a plate 110 interposed between the slab and the top of the workpiece 12. By adjusting the distance each post 108 extends below the slab 106, the degree to which the plate 110 conformally contacts the top of the workpiece can be adjusted.

To apply a sideward pressure to the workpiece 12, the slab 106 is provided with a first pair of fingers 110—110 which depend from the undersurface of the slab in spaced-apart relationship. Each finger 110 has an cammed surface 112 thereon for contacting a complementary cammed surface on the counterweight 86 carried by a separate one of the arms 60 and 62. The distance between the fingers 110—110 is slightly less than the lateral distance between the arm counterweights 86 when the arms 60 and 62 are rotated towards each other. In this way, when a downward pressure is applied to the slab 106, the fingers 110—110 contact the arm counterweights 86—86, causing the arms 60 and 62 to be urged toward each together.

The slab 106 is provided with a second pair of fingers 114—114, each secured to a separate one of the sides of the slab by a separate one of a pair of thumbscrews 116—116. The fingers 116—116 each have a lower portion 118 which projects horizontally inward towards the other finger for contacting the arm counterweight 86 to apply a lateral pressure to thereto. A spring 120 is interposed between the edge of the slab 106 and the upper end of each finger 114 to yieldably bias the arm, and particularly, the lower portion 118 thereof away from the corresponding arm counterweight 86.

The fixture 10 operates in the following manner. Initially, the pneumatic cylinder 100 of FIG. 1 is operated so that the arms 60 and 62 of FIGS. 1-5 are rotated apart. Thereafter, the workpiece 12 is placed within the area 48 (see FIG. 2) between the jaw assemblies 68 and 70. The cylinder 100 is then operated to rotate the arms 60 and 62 towards each other so that the workpiece 12 is clamped between the jaws assemblies 68 and 70. As described above, the jaws 78 and 80 of each of the jaw assemblies 68 and 70 are spring-biased so as to float along the x, y and z axes 16, 28 and 38, respectively, thereby accommodating minor dimensional variations in the workpiece.

Once the workpiece 12 is clamped, then, if desired, the pressure plate assembly 104 of FIG. 6 may be placed over the workpiece. Thereafter, the cylinders 18 and 30 are operated to displace the block 40 to the appropriate x and y coordinates as required. For example, in the case where the workpiece 12 is to be contact-resistance-welded, the cylinders 18 and 30 are operated to displace the block so that each of the pair of electrodes (not shown) in the plate 46 can be brought into contact with an electrical terminal (not shown).

The foregoing discloses an automatically operated clamping fixture 10 for releasably clamping a workpiece 12, having dimensional variations, with a reduced incident of damage thereto.

It is to be understood that the above-described embodiments are merely illustrative of the principles of the invention. Various modifications and changes may be made thereto by those skilled in the art which will embody the principles of the invention and fall within the spirit and scope thereof.

We claim:

1. An apparatus for clamping a workpiece, having minor dimensional variations, so as to avoid damaging the workpiece, comprising:

a support;

a pair of arms each journalled to the support so as to rotate to and from each other;

means coupled to said arms for rotating said arms to and from each other;

jaw means carried by each arm opposite the jaw means on the other arm, each jaw means spring-biased to a separate one of the arms so as to be capable of being yieldably moved a limited distance along a separate one of three orthogonal axes for conformally gripping a workpiece when the arms are rotated together, each jaw means including:

a jaw carrier spring-biased to a separate one of the arms so as to be capable of being yieldably moved a limited distance along a first one of the three orthogonal axes, the jaw carrier having first and second opposed, tapered surfaces thereon; and at least first and second jaws secured to each other by a spring so as to ride on the first and second tapered surfaces, respectively, on the jaw carrier and being capable of being yieldably moved along a second and third one of the three axes as each jaw contacts the workpiece.

2. The apparatus according to claim 1 wherein each jaw means further includes:

third and fourth jaws secured to each other by a spring so as to ride on the first and second tapered surfaces, respectively, on the jaw carrier and being capable of being yieldably moved along a second and a third one of the three axes as each jaw contacts the workpiece.

3. The apparatus according to claim 1 wherein the means for rotating the arms comprises:

a cam follower carried by each arm;

a cam journalled to the support for rotation, the cam having each of a pair of opposed, arcuate slots therein, each receiving a separate one of the cam followers;

a gear member secured to the cam so as to be coaxial therewith;

a gear rack in meshing engagement with the gear member;

an actuator coupled to the gear rack for reciprocating the gear rack to rotate the gear member and the cam so as to rotate the arms to and from each other.

4. The apparatus according to claim 1 further including:

a slide for slidably supporting the support; and a first actuator coupled between the support and the slide for displacing the support along a first one of three orthogonal axes.

5. The apparatus according to claim 4 further including:

a frame for slidably supporting the slide for movement along a second one of the axes perpendicular to, but lying in the same plane as, the first axis; and a second actuator coupled between the frame and the slide for displacing the slide, and hence the support, along the second axis.

6. The apparatus according to claim 1 further including pressure plate means for applying a downward pressure and opposing lateral pressures to the workpiece once clamped by the jaw means.

* * * * *